US010957976B2

(12) United States Patent
Lee et al.

(10) Patent No.: US 10,957,976 B2
(45) Date of Patent: Mar. 23, 2021

(54) PEDESTAL APPARATUS HAVING ANTENNA ATTACHED THERETO CAPABLE OF BIAXIAL MOTION

(71) Applicant: INTELLIAN TECHNOLOGIES, INC., Pyeongtaek-si (KR)

(72) Inventors: Hyun Uk Lee, Goyang-si (KR); A Reum Han, Seoul (KR)

(73) Assignee: INTELLIAN TECHNOLOGIES, INC., Pyeongtaek-si (KR)

( * ) Notice: Subject to any disclaimer, the term of this patent is extended or adjusted under 35 U.S.C. 154(b) by 30 days.

(21) Appl. No.: 16/313,222

(22) PCT Filed: Jun. 30, 2016

(86) PCT No.: PCT/KR2016/007086
§ 371 (c)(1),
(2) Date: Feb. 15, 2019

(87) PCT Pub. No.: WO2018/004039
PCT Pub. Date: Jan. 4, 2018

(65) Prior Publication Data

US 2019/0173170 A1 Jun. 6, 2019

(30) Foreign Application Priority Data

Jun. 30, 2016 (KR) ..... 10-2016-0082481

(51) Int. Cl.
*H01Q 1/12* (2006.01)
*H01Q 3/08* (2006.01)
(Continued)

(52) U.S. Cl.
CPC ..... *H01Q 3/08* (2013.01); *H01Q 1/12* (2013.01); *H01Q 1/125* (2013.01); *H01Q 1/27* (2013.01); *H01Q 1/28* (2013.01)

(58) Field of Classification Search
CPC .. H01Q 1/08; H01Q 1/12; H01Q 1/18; H01Q 1/28; H01Q 1/34; H01Q 1/125; H01Q 3/08; H01Q 3/18
(Continued)

(56) References Cited

U.S. PATENT DOCUMENTS 4,396,919 A 8/1983 Speicher
5,389,940 A 2/1995 Sutherland
(Continued)

FOREIGN PATENT DOCUMENTS

CN 201134506 Y 10/2008
CN 102528796 A 7/2012
(Continued)

OTHER PUBLICATIONS

International Search Report for related International Application No. PCT/KR2016/007086; dated Apr. 12, 2017.
(Continued)

*Primary Examiner* — Tung X Le
(74) *Attorney, Agent, or Firm* — von Briessen & Roper, s.c.

(57) ABSTRACT

Disclosed is a pedestal apparatus having an antenna attached thereto capable of biaxial motion. The pedestal apparatus according to one embodiment may comprise: a body; a first drive unit, arranged on the lower part of the body, for transmitting driving power; a second drive unit, arranged on the lower part of the body, for transmitting driving power; a first drive gear arranged on the upper part of the body and receiving driving power from the first drive unit; a second drive gear arranged on the upper part of the body opposite the first drive gear, and receiving driving power from the second drive unit; and a driven gear which rotates by receiving driving power from the first and second drive gears, and to which an antenna is connected, wherein the
(Continued)

antenna can move biaxially in accordance with the rotational directions of the first and second drive gears.

13 Claims, 16 Drawing Sheets

(51) Int. Cl.
*H01Q 1/27* (2006.01)
*H01Q 1/28* (2006.01)

(58) Field of Classification Search
USPC ..... 343/757, 763, 765, 766, 878
See application file for complete search history.

(56) References Cited

U.S. PATENT DOCUMENTS 5,517,204 A * 5/1996 Murakoshi ..... H01Q 1/18 248/183.1
5,983,071 A 11/1999 Gagnon et al.
6,285,338 B1 * 9/2001 Bai ..... H01Q 3/08 343/880
6,313,805 B1 * 11/2001 Nishiyama ..... H01Q 3/04 343/766
6,559,806 B1 * 5/2003 Watson ..... H01Q 1/125 343/758
2001/0028327 A1 * 10/2001 Yamamoto ..... H01Q 3/08 343/757
2008/0297427 A1 * 12/2008 Jung ..... H01Q 1/1257 343/766
2009/0085826 A1 * 4/2009 Conrad ..... H01Q 1/3275 343/882
2010/0149059 A1 * 6/2010 Patel ..... H01Q 1/18 343/765
2011/0241971 A1 10/2011 Bateman et al.
2014/0299734 A1 * 10/2014 Nielsen ..... H01Q 1/005 248/560
2017/0025752 A1 * 1/2017 Zimmerman ..... H01Q 1/42

FOREIGN PATENT DOCUMENTS

CN 202399270 U 8/2012
CN 102856648 A 1/2013
CN 103972651 A 8/2014
EP 0514656 A1 11/1992
GB 2266996 A 11/1993
JP H07249914 A 9/1995
JP H09199924 A 7/1997
JP 2002043820 A 2/2002
JP 2007081856 A 3/2007
KR 1020110024441 A 3/2011
WO WO 03/096476 a1 11/2003

OTHER PUBLICATIONS

Extended European Search Report for related Application No. 16907404.4; dated Jan. 22, 2020.
Chinese Office Action related to Application No. 201680087321.7; dated Jun. 15, 2020.

* cited by examiner

PEDESTAL APPARATUS HAVING ANTENNA ATTACHED THERETO CAPABLE OF BIAXIAL MOTION

CROSS-REFERENCE TO RELATED APPLICATION

This Application is a 35 USC § 371 US National Stage filing of International Application No. PCT/KR2016/007086 filed on Jun. 30, 2016, and claims priority under the Paris Convention to South Korean Patent Application No. 10-2016-0082481 filed on Jun. 30, 2016.

TECHNICAL FIELD

Hereinafter, a pedestal apparatus mounted with an antenna capable of biaxial motion will be disclosed.

BACKGROUND ART

An antenna, which is provided on a movable body such as a flight vehicle, a body of a motor vehicle, and a hull of a ship, is a device for receiving a signal from a satellite and transmitting a signal to the satellite. Because the antenna receives the signal while tracking the satellite regardless of a position of the antenna, a pedestal apparatus for supporting the antenna is provided to prevent a loss of the signal caused when the movable body sways. That is, the pedestal apparatus supports and fixes the antenna and may rotate in accordance with the motion of the movable body so that the antenna transmits and receives the signal to/from the satellite.

The pedestal apparatus may infinitely rotate as a rotating plate of the pedestal apparatus rotates about an axis perpendicular to the floor, and as a result, a slip ring and a rotary joint need to be mounted to essentially prevent a power cable and an RF signal cable from being twisted. In the slip ring, because mechanical objects in the form of brushes are in contact with each other and rotate in a high-voltage/high-current state, there is a limitation in terms of a life span of components. In particular, the rotary joint for transmitting and/or receiving RF signals is a significantly high-priced component. In a case in which the number of components is increased to implement the infinite rotation of the pedestal apparatus, costs may be greatly increased and a capacity of a bearing and a capacity of a drive motor may be increased.

For example, Korean Patent Application Laid-Open No. 10-2011-0024441 discloses a pedestal apparatus.

SUMMARY

An object according to an exemplary embodiment is to provide a pedestal apparatus which need not infinitely rotate in terms of an azimuth angle and may reduce a capacity and a weight of a motor and a capacity and a weight of a rotary joint by reducing a load of a part that needs to be operated.

Another object according to the exemplary embodiment is to provide a pedestal apparatus which may improve structural stability by fixing a drive unit to a lower portion thereof.

Still another object according to the exemplary embodiment is to provide a pedestal apparatus in which a distance between a driving power transmitting unit and a drive unit may be adjusted, such that antennae having various sizes may be mounted.

Yet another object according to the exemplary embodiment is to provide a pedestal apparatus which stably supports a satellite tracking antenna.

Still yet another object according to the exemplary embodiment is to provide a pedestal apparatus which maintains a position of an antenna in accordance with a direction of a target satellite even though an external state is changed.

A further object according to the exemplary embodiment is to provide a pedestal apparatus which moves so that an antenna is directed with respect to two axes.

Another further object according to the exemplary embodiment is to provide a pedestal apparatus which improves a tracking speed of an antenna.

A pedestal apparatus having an antenna attached thereto capable of biaxial motion according to an exemplary embodiment may include: a body; a first drive unit which is disposed on a lower portion of the body and transmits power; a second drive unit which is disposed on the lower portion of the body and transmits power; a first driving gear which is disposed on an upper portion of the body and receives power from the first drive unit; a second driving gear which is disposed on the upper portion of the body so as to face the first driving gear and receives power from the second drive unit; and a driven gear which is rotated by receiving power from the first driving gear and the second driving gear and connects to an antenna, in which the antenna may perform biaxial motion in accordance with rotation directions of the first driving gear and the second driving gear.

According to one aspect, the driven gear may include a first driven gear which engages with the first driving gear and the second driving gear, and a second driven gear which faces the first driven gear and engages with the first driving gear and the second driving gear.

According to one aspect, the first drive unit and the second drive unit may rotate the first driving gear and the second driving gear in the same direction so that the antenna is rotated about one axis, and the first drive unit and the second drive unit may rotate the first driving gear and the second driving gear in different directions so that the antenna is rotated about the other axis orthogonal to the one axis.

According to one aspect, the pedestal apparatus may include: a first driving belt which is connected to a driving shaft of the first drive unit, controls the rotation direction of the first driving gear, and transmits power to the first driving gear; and a second driving belt which is connected to a driving shaft of the second drive unit, controls the rotation direction of the second driving gear, and transmits power to the second driving gear.

According to one aspect, the pedestal apparatus may include: a first support member which is coupled to one side of the first driven gear and has a first support that extends radially from one side; and a second support member which is coupled to one side of the second driven gear and has a second support that extends radially from one side.

According to one aspect, the pedestal apparatus may include a support plate which is connected to the first support member and the second support member and has an antenna coupling hole in which the antenna is mounted.

A pedestal apparatus having an antenna attached thereto capable of biaxial motion according to an exemplary embodiment may include: a body; a first drive unit which is disposed adjacent to the body and transmits power; a second drive unit which is disposed adjacent to the body and transmits power; a driving power transmitting unit which is connected to the body and receives power from the first drive unit and the second drive unit to allow an antenna to perform biaxial motion; and an antenna coupling unit which is biaxially and rotatably connected to the driving power transmitting unit and has one end at which the antenna is mounted.

According to one aspect, the driving power transmitting unit may include: a first rotary link which is connected to the first drive unit; a second rotary link which is connected to the second drive unit; an inner adjustment link which is coupled to one end of the first rotary link; an outer adjustment link which is coupled to one end of the second rotary link; an inner gimbal which has one side connected to the inner adjustment link and one end at which the antenna coupling unit is mounted; and an outer gimbal which has one side connected to the outer adjustment link and connects to the inner gimbal.

According to one aspect, the first drive unit may rotate the first rotary link so that the antenna is rotated about one axis, and the second drive unit may rotate the second rotary link so that the antenna is rotated about the other axis orthogonal to one axis.

According to one aspect, the driving power transmitting unit may include: a first driving gear which is disposed on an upper portion of the body and receives power from the first drive unit; and a second driving gear which is disposed on the upper portion of the body so as to be orthogonal to the first driving gear and receives power from the second drive unit, and the antenna coupling unit may include: a first coupling portion which is disposed at one side thereof and connected to the first driving gear; and a second coupling portion which is disposed adjacent to the first coupling portion and connected to the second driving gear.

According to one aspect, the pedestal apparatus may include: a first rotary member which is attached to the first driving gear and rotatable about one axis; and a second rotary member which is attached to the second driving gear and rotatable about the other axis.

According to one aspect, the first rotary member may include a first support shaft which is aligned with a rotation axis of the second driving gear and connected to the first coupling portion, and the second rotary member may include a second support shaft which is aligned with a rotation axis of the first driving gear and connected to the second coupling portion.

According to one aspect, the driving power transmitting unit may include: a first driving gear which is disposed at one side of the body and receives power from the first drive unit; a second driving gear which is disposed at the other side of the body so as to be spaced apart from the first driving gear and receives power from the second drive unit; an outer gimbal which is connected to the first driving gear inside the body so as to be rotatable in one axial direction and has a first antenna path at one side thereof; and an inner gimbal which is connected to the second driving gear inside the body so as to be rotatable in the other axial direction and has a second antenna path therein, and the antenna coupling unit may be disposed in the first antenna path and the second antenna path and connected to the inner gimbal.

According to one aspect, the first drive unit may rotate the first driving gear so that the antenna coupling unit is moved along the first antenna path, the second drive unit may rotate the second driving gear so that the antenna coupling unit is moved along the second antenna path, and the antenna may perform biaxial motion in accordance with a rotation of the first driving gear and a rotation of the second driving gear.

According to one aspect, the outer gimbal may be formed in a curved shape in a direction outward from the body, and the first antenna path may be formed along a circumference of the outer gimbal.

Advantageous Effects

The pedestal apparatus according to the exemplary embodiment need not infinitely rotate in terms of an azimuth angle and may reduce a capacity and a weight of the motor and a capacity and a weight of the rotary joint by reducing a load of a part that needs to be operated.

The pedestal apparatus according to the exemplary embodiment may improve structural stability by fixing the drive unit to the lower portion thereof.

The pedestal apparatus according to the exemplary embodiment may enable antennae having various sizes to be mounted since a distance between the driving power transmitting unit and the drive unit may be adjusted.

The pedestal apparatus according to the exemplary embodiment may stably support the satellite tracking antenna.

The pedestal apparatus according to the exemplary embodiment may maintain a position of the antenna in accordance with a direction of a target satellite even though an external state is changed.

The pedestal apparatus according to the exemplary embodiment may move so that the antenna is directed with respect to two axes.

The pedestal apparatus according to the exemplary embodiment may improve a tracking speed of the antenna.

The effects of the pedestal apparatus according to the exemplary embodiment are not limited to the aforementioned effects, and other effects, which are not mentioned above, may be clearly understood by those skilled in the art from the following descriptions.

DETAILED DESCRIPTION

Figure 1:
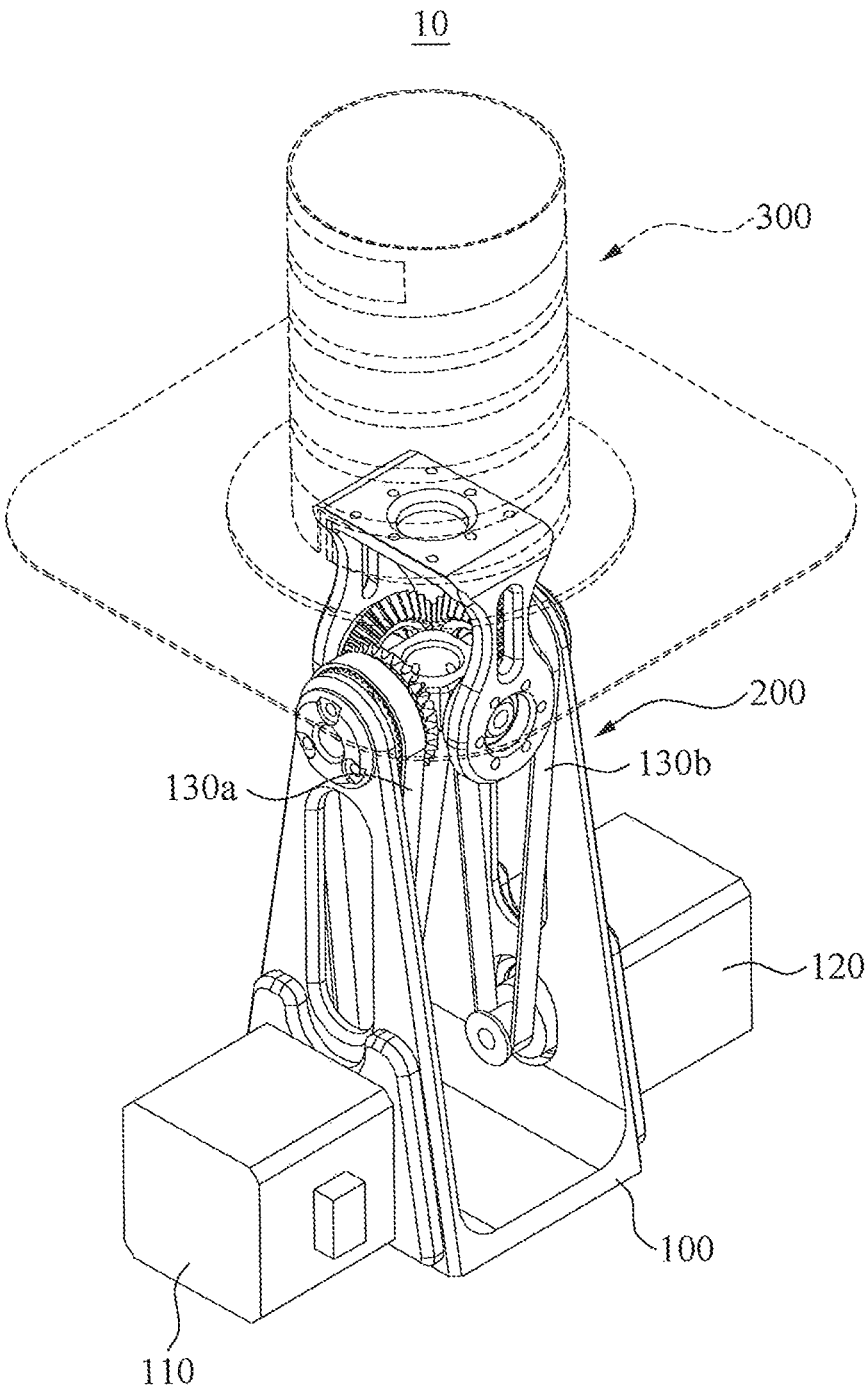
FIG. 1 is a perspective view schematically illustrating a pedestal apparatus according to an exemplary embodiment.

Hereinafter, exemplary embodiments will be described in detail with reference to the illustrative drawings. In denoting reference numerals to constituent elements of the respective drawings, it should be noted that the same constituent elements will be designated by the same reference numerals, if possible, even though the constituent elements are illustrated in different drawings. Further, in the following description of the present exemplary embodiments, a detailed description of publicly known configurations or functions incorporated herein will be omitted when it is determined that the detailed description obscures the subject matters of the present exemplary embodiments.

In addition, the terms first, second, A, B, (a), and (b) may be used to describe constituent elements of the exemplary embodiments of the present invention. These terms are used only for the purpose of discriminating one constituent element from another constituent element, and the nature, the sequences, or the orders of the constituent elements are not limited by the terms. When one constituent element is described as being "connected", "coupled", or "attached" to another constituent element, it should be understood that one constituent element can be connected or attached directly to another constituent element, and an intervening constituent element can also be "connected", "coupled", or "attached" to the constituent elements.

The constituent element, which has the same common function as the constituent element included in any one exemplary embodiment, will be described by using the same name in other exemplary embodiments. Unless disclosed to the contrary, the configuration disclosed in any one exemplary embodiment may be applied to other exemplary embodiments, and the specific description of the repeated configuration will be omitted.

A pedestal apparatus 10, which is mounted on a movable body such as a ship and on which a satellite tracking antenna may be mounted, will be described as an example of the pedestal apparatus 10 mounted with an antenna capable of biaxial motion according to an exemplary embodiment, but in addition to the antenna, an operating body and the like, which need to perform various types of motion, may be mounted on the pedestal apparatus 10.

Referring to FIG. 1, the pedestal apparatus 10 mounted with the antenna capable of biaxial motion according to the exemplary embodiment may include a body 100, a first drive unit 110 which is disposed on a lower portion of the body 100 and transmits power, a second drive unit 120 which is disposed on the lower portion of the body 100 and transmits power, a driving power transmitting unit 200 which is connected to the body 100 and receives power from the first drive unit 110 and the second drive unit 120 to allow the antenna to perform biaxial motion about two axes, and an antenna coupling unit 300 which is biaxially and rotatably connected to the driving power transmitting unit 200 and has one end at which the antenna is mounted.

The body 100 may be formed such that one side of the body 100 becomes narrower from the lower portion of the body 100 to an upper portion of the body 100 in order to stably support the antenna.

The first drive unit 110 and the second drive unit 120 may be disposed on the lower portion of the body 100. Specifically, the first drive unit 110 and the second drive unit 120 may be disposed adjacent to one side of the lower portion of the body 100 and may be disposed to face each other. In addition, the first drive unit 110 and the second drive unit 120 may be in direct contact with the body 100, but connection members may be interposed between the first drive unit 110 and the body 100 and between the second drive unit 120 and the body 100, respectively, in order to reduce vibration generated from the first drive unit 110 and the second drive unit 120.

Each of the first drive unit 110 and the second drive unit 120 may be a rotary motor. The first drive unit 110 and the second drive unit 120 may be connected to a first driving gear 210*a* and a second driving gear 210*b*, respectively, which will be described below, and the first drive unit 110 and the second drive unit 120 may control a rotation of the first driving gear 210*a* and a rotation of the second driving gear 210*b*, respectively. In addition, each of the first drive unit 110 and the second drive unit 120 may be a linear actuator. That is, each of the first drive unit 110 and the second drive unit 120 may be a drive unit using a direct-drive cylinder and a rotating body that use hydraulic pressure or pneumatic pressure.

Figure 2:
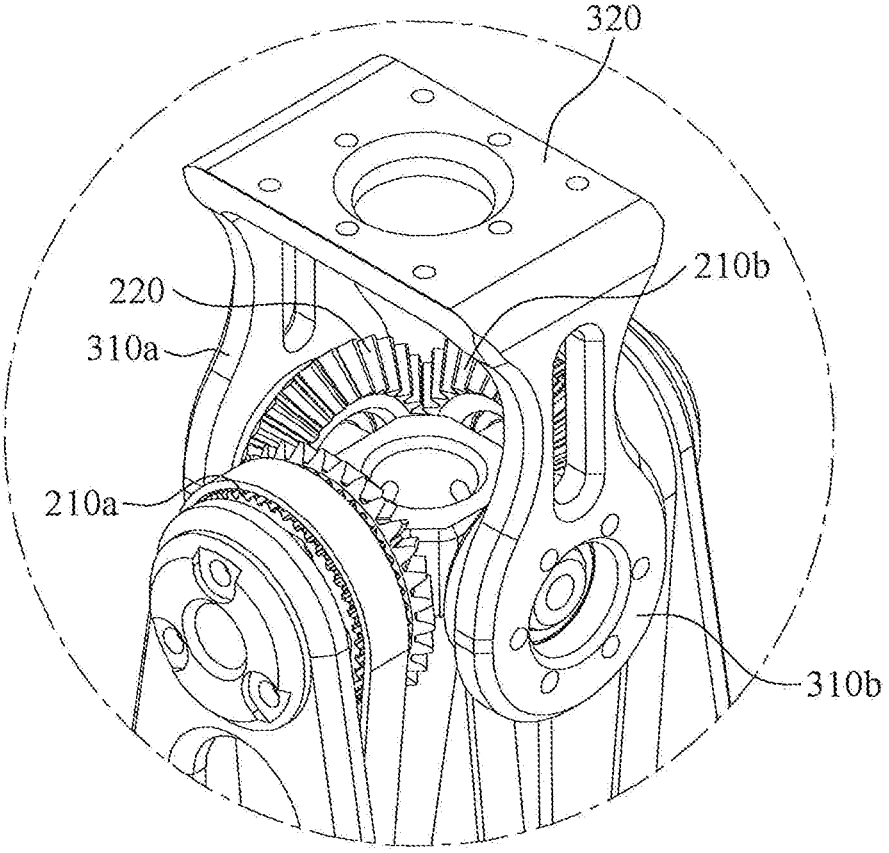
FIG. 2 is an enlarged view illustrating a configuration of a driving power transmitting unit of the pedestal apparatus.

Referring to FIG. 2, the driving power transmitting unit 200 may include the first driving gear 210*a* which is disposed on the upper portion of the body 100 and receives power from the first drive unit 110, the second driving gear 210*b* which is disposed on the upper portion of the body 100 so as to face the first driving gear 210*a* and receives power from the second drive unit 120, and a driven gear 220 which engages with the first driving gear 210*a* and the second driving gear 210*b*, rotates by receiving power from the first driving gear 210*a* and the second driving gear 210*b*, and connects to the antenna.

The first driving gear 210*a* may receive power from the first drive unit 110. Specifically, the first driving gear 210*a* may be connected to a driving shaft of the first drive unit 110 by means of a first driving belt 130*a*, and the first driving belt 130*a* may control a rotation direction of the first driving gear 210*a* and may transmit power to the first driving gear 210*a*. A direction of the first driving gear 210*a* may be determined depending on a rotation direction of the driving shaft of the first drive unit 110. Likewise, the second driving gear 210*b* may receive power from the second drive unit 120. Specifically, the second driving gear 210*b* may be connected to a driving shaft of the second drive unit 120 by means of a second driving belt 130*b*, and the second driving belt 130*b* may control a rotation direction of the second driving gear 210*b* and may transmit power to the second driving gear 210*b*. A direction of the second driving gear 210*b* may be determined depending on a rotation direction of the driving shaft of the second drive unit 120.

In addition, the first driving gear 210*a* and the second driving gear 210*b* may be connected to the first drive unit 110 and the second drive unit 120 by means of the first driving belt 130*a* and the second driving belt 130*b*, respectively, but the first driving gear 210*a* and the second driving gear 210*b* may be connected to the first drive unit 110 and the second drive unit 120, respectively, by means of one of all applicable methods such as gears, wires, or cams or a combination thereof.

As described above, the first driving gear 210*a* and the second driving gear 210*b* may be disposed on the body 100 so as to be spaced apart from the first drive unit 110 and the second drive unit 120, and the first driving gear 210*a* and the second driving gear 210*b* may be disposed on the body 100 such that a distance between the first driving gear 210*a* and the first drive unit 110 and a distance between the second driving gear 210*b* and second drive unit 120 are adjusted, and as a result, antennae having various sizes may be mounted on the pedestal apparatus 10.

The driven gear 220 may receive power from the first driving gear 210*a* and the second driving gear 210*b*. In addition, the antenna may be connected to the driven gear 220. As a result, the antenna may perform the biaxial motion in accordance with the rotation directions of the first driving gear 210*a* and the second driving gear 210*b*.

The driven gear 220 may include a first driven gear 220*a* which engages with the first driving gear 210*a* and the second driving gear 210*b*, and a second driven gear 220*b* which faces the first driven gear 220*a* and engages with the first driving gear 210*a* and the second driving gear 210*b*. The first driven gear 220*a* and the second driven gear 220*b* may receive power from the first driving gear 210*a* and the second driving gear 210*b*. In addition, the antenna may be connected to the first driven gear 220*a* and the second driven gear 220*b*.

As described above, the pedestal apparatus 10 may include both of the first driven gear 220*a* and the second driven gear 220*b* or may include any one of the first driven gear 220*a* and the second driven gear 220*b* that engage with the first driving gear 210*a* and the second driving gear 210*b*.

The driving power transmitting unit 200 may include a first support member 310*a* which is coupled to one side of the first driven gear 220*a* and has a first support that extends radially from one side, and a second support member 310*b* which is coupled to one side of the second driven gear 220*b* and has a second support that extends radially from one side.

The first support member 310*a* may be coupled to one side of the first driven gear 220*a*. Therefore, the first support member 310*a* may be rotated together with the first driven gear 220*a* when the first driven gear 220*a* is rotated. In addition, the first support member 310*a* may have the first support that extends radially from one side. Likewise, the second support member 310*b* may be coupled to one side of the second driven gear 220*b*. Therefore, the second support member 310*b* may be rotated together with the second driven gear 220*b* when the second driven gear 220*b* is rotated. In addition, the second support member 310*b* may have the second support that extends radially from one side.

In addition, the driving power transmitting unit 200 may include a support plate 320 which is connected to the first support member 310*a* and the second support member 310*b* and has an antenna coupling hole into which the antenna is mounted. Therefore, the antenna may be securely fixed to the support plate 320. In addition, the support plate 320 may be connected to the first support member 310*a* and the second support member 310*b*. Specifically, the support plate 320 may be coupled to the first support and the second support. Therefore, the support plate 320 may be stably supported, and thus the antenna may also be stably supported. In addition, since the support plate 320 is connected to the first support member 310*a* and the second support member 310*b*, the support plate 320 may be rotated in the rotation directions of the first driven gear 220*a* and the second driven gear 220*b*.

Figure 3:
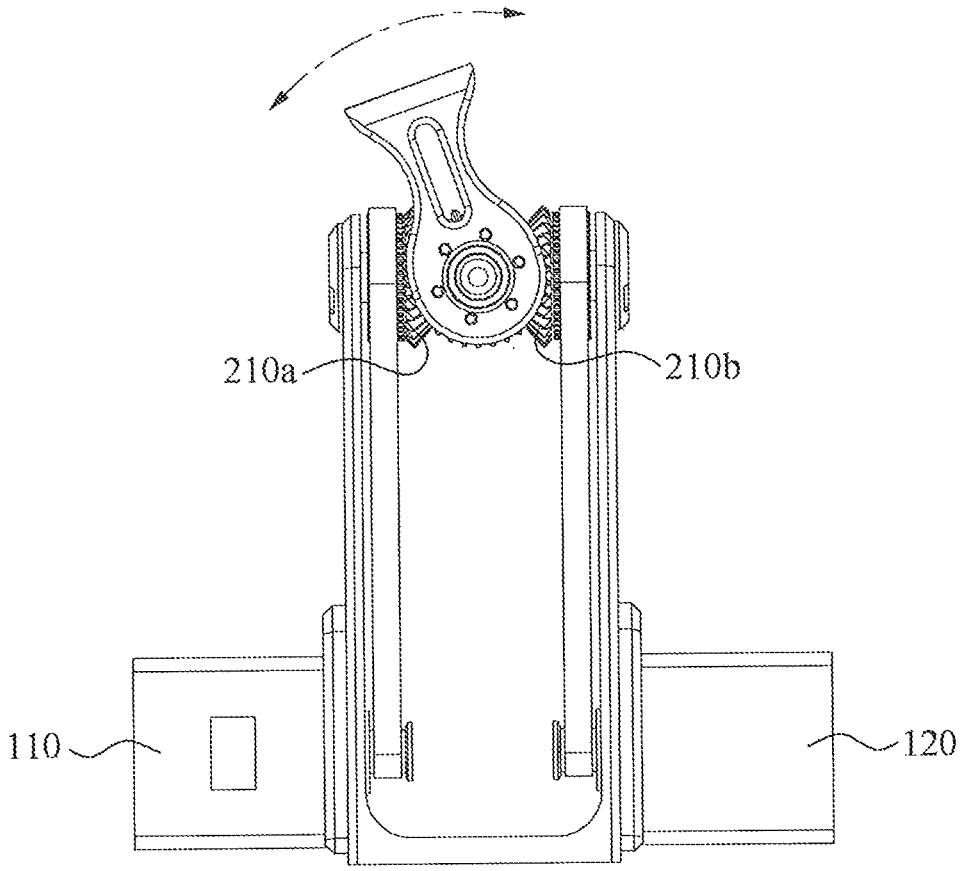
FIG. 3 is an operational view illustrating a state in which the pedestal apparatus is rotated about one axis.

Referring to FIG. 3, when the first drive unit 110 and the second drive unit 120 rotate the first driving gear 210*a* and the second driving gear 220*b* in different directions so that the antenna is rotated about one axis, the first driven gear 220*a* and the second driven gear 220*b* are rotated in the directions in which the first driven gear 220*a* and the second driven gear 220*b* engage with the first driving gear 210*a* and the second driving gear 220*b*, and as a result, the antenna may be rotated about one axis.

Figure 4:
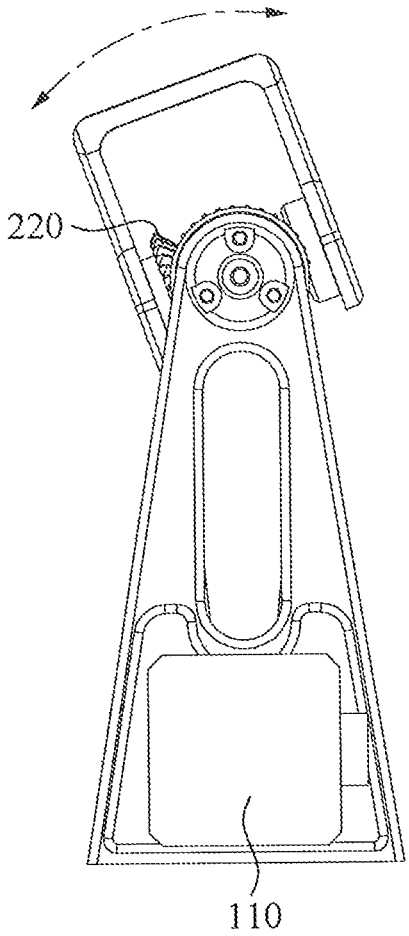
FIG. 4 is an operational view illustrating a state in which the pedestal apparatus is rotated about the other axis.

Referring to FIG. 4, when the first drive unit 110 and the second drive unit 120 rotate the first driving gear 210*a* and the second driving gear 220*b* in the same direction so that the antenna is rotated about the other axis orthogonal to one axis, the first driven gear 220*a* and the second driven gear 220*b* are fixed without being rotated, and thus the antenna may be rotated about the other axis.

In the pedestal apparatus 10, the first driving gear 210*a* and the second driving gear 210*b* are disposed to face each other, and the first drive unit 110 and the second drive unit 120, which serve as independent drive units for the first driving gear 210*a* and the second driving gear 210*b*, are disposed, such that the antenna may be rotated about one axis in the state in which the shaft of the driven gear 220 is fixed when the driving shaft of the first drive unit 110 and the driving shaft of the second drive unit 120 are rotated in the different directions, and the antenna may be rotated about the other axis in the state in which teeth of the driven gear 220 are fixed when the driving shaft of the first drive unit 110 and the driving shaft of the second drive unit 120 are rotated in the same direction. Therefore, the antenna may be oriented within a hemispheric range while being rotated about the two axes without interference of a cable connected to the antenna.

A modified example of the pedestal apparatus 10 according to the exemplary embodiment will be described with reference to FIGS. 5 to 16.

Figure 5:
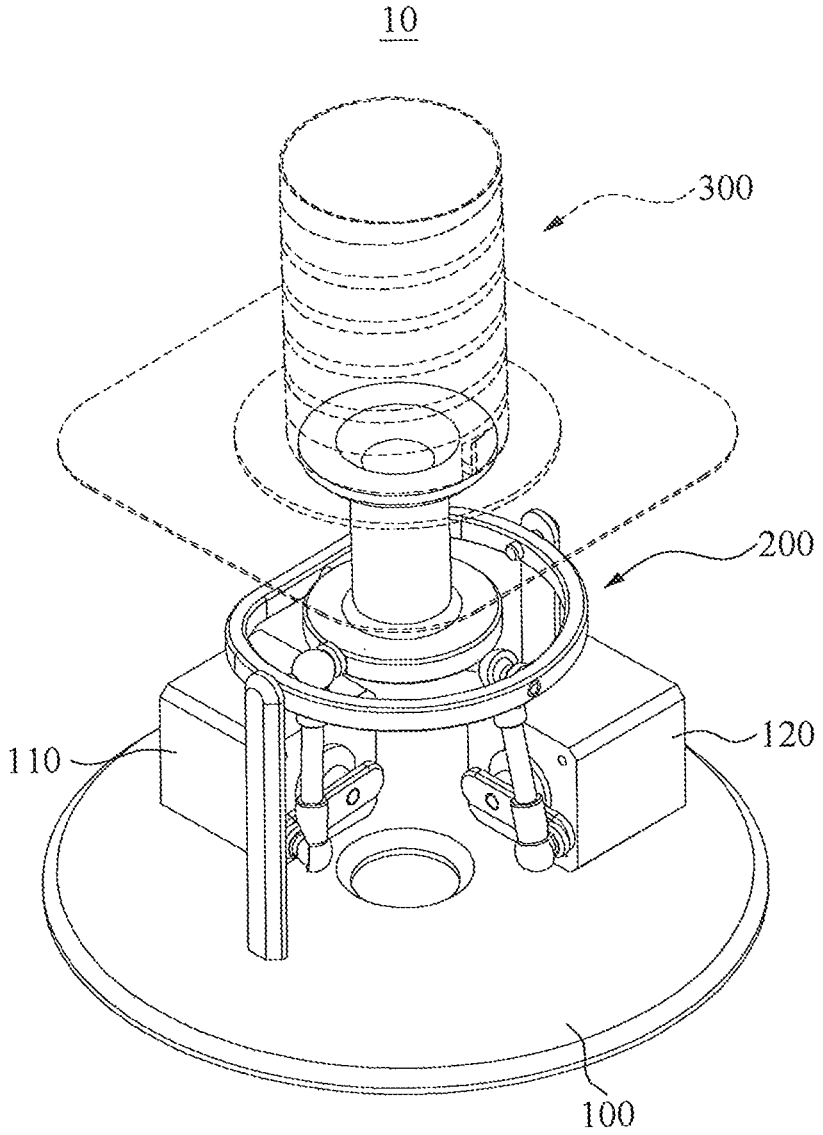
FIG. 5 is a perspective view schematically illustrating a modified example of the pedestal apparatus according to the exemplary embodiment.
Figure 6:
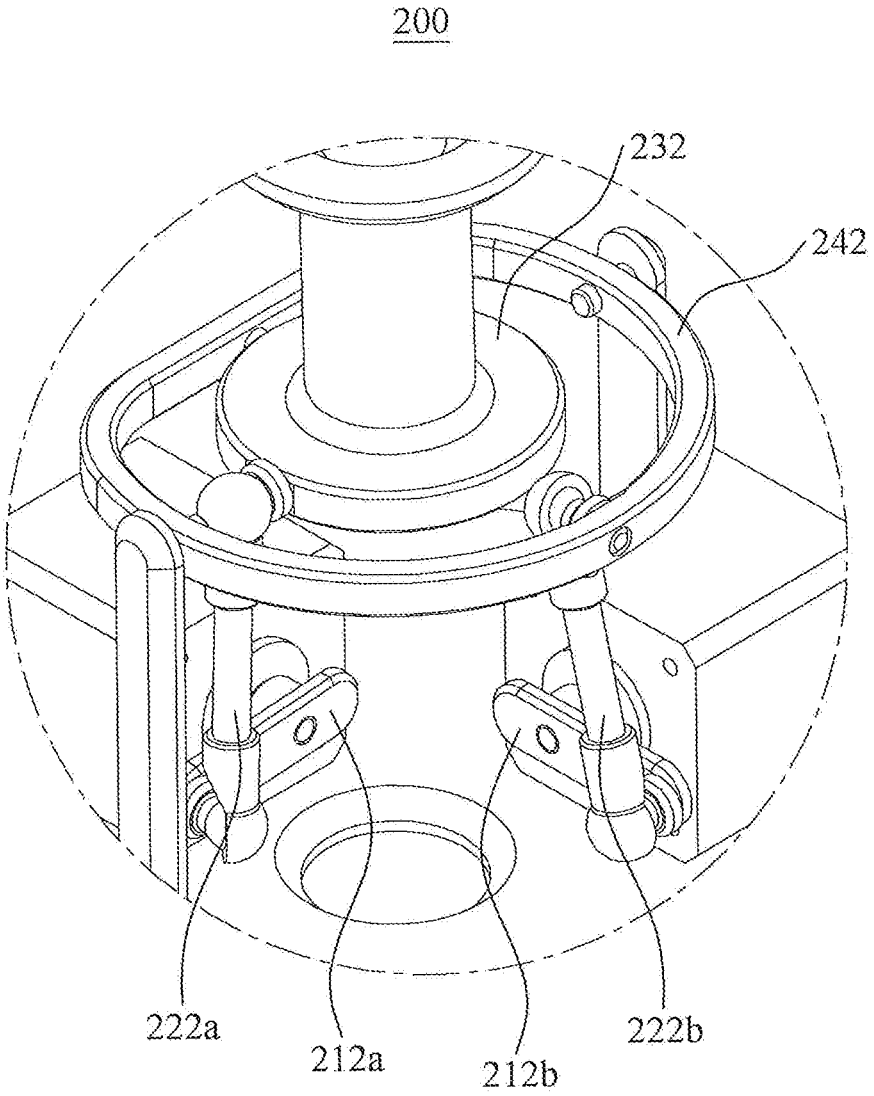
FIG. 6 is an enlarged view illustrating a configuration of a driving power transmitting unit of the modified example of the pedestal apparatus.

Referring to FIGS. 5 and 6, a driving power transmitting unit 200 may include a first rotary link 212*a* which is connected to a first drive unit 110, a second rotary link 212*b* which is connected to a second drive unit 120, an inner adjustment link 222*a* which is coupled to one end of the first rotary link 212*a*, an outer adjustment link 222*b* which is coupled to one end of the second rotary link 212*b*, an inner gimbal 232 which has one side connected to the inner adjustment link 222*a* and one end at which the antenna coupling unit 300 is mounted, and an outer gimbal 242 which has one side connected to the outer adjustment link 222*b* and connects to the inner gimbal 232.

The first rotary link 212*a* may be rotatably connected to the first drive unit 110. When power is generated from the first drive unit 110, the first rotary link 212*a* may receive the power from the first drive unit 110 and may be rotated about a driving shaft of the first drive unit 110. Likewise, the second rotary link 212*b* may be rotatably connected to the second drive unit 120. When power is generated from the second drive unit 120, the second rotary link 212*b* may receive the power from the second drive unit 120 and may be rotated about a driving shaft of the second drive unit 120.

The inner adjustment link 222*a* or the outer adjustment link 222*b* may be coupled to any one end of the first rotary link 212*a* or any one end of the second rotary link 212*b*. Hereinafter, for convenience of description, a configuration in which the inner adjustment link 222*a* is coupled to one end of the first rotary link 212*a* and the outer adjustment link 222*b* is coupled to one end of the second rotary link 212*b* will be described. The inner adjustment link 222*a* and the outer adjustment link 222*b* are coupled to one end of the first rotary link 212*a* and one end of the second rotary link 212*b*, respectively, thereby converting the rotational motion of the first rotary link 212*a* and the second rotary link 212*b* to the rectilinear motion.

The inner gimbal 232 may be connected to the inner adjustment link 222*a*. Specifically, the inner adjustment link 222*a* may be connected to one side of the inner gimbal 232, and the inner gimbal 232 may be rotated about one axis due to the rectilinear motion of the inner adjustment link 222*a*. In addition, the antenna coupling unit 300 may be mounted at one end of the inner gimbal 232.

The outer gimbal 242 may be connected to the outer adjustment link 222*b*. Specifically, the outer adjustment link 222*b* may be connected to one side of the outer gimbal 242, and the outer gimbal 242 may be rotated about the other axis orthogonal to one axis due to the rectilinear motion of the outer adjustment link 222*b*. In addition, the antenna coupling unit 300 may be mounted at one end of the outer gimbal 242.

One side of the inner gimbal 232, to which the inner adjustment link 222*a* is connected, and one side of the outer gimbal 242, to which the outer adjustment link 222*b* is connected, may be orthogonal to each other. Therefore, the rotation direction of the inner gimbal 232 and the rotation direction of the outer gimbal 242 may be orthogonal to each other, and as a result, the antenna connected to one end of the inner gimbal 232 may perform the biaxial motion.

Figure 7:
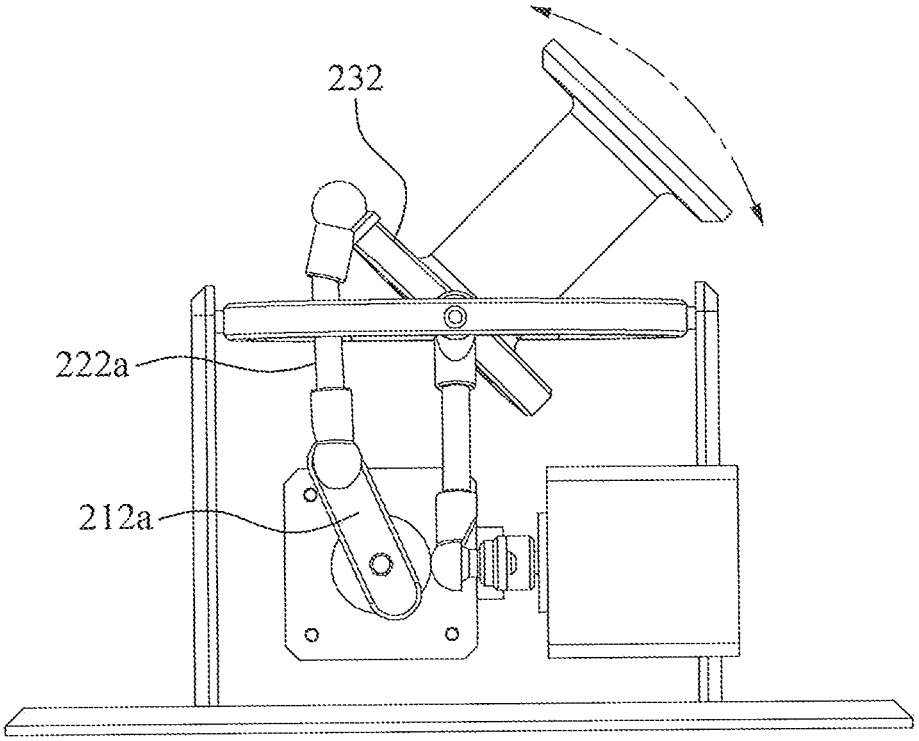
FIG. 7 is an operational view illustrating a state in which the pedestal apparatus according to the modified example is rotated about one axis.

Referring to FIG. 7, the first drive unit 110 may rotate the first rotary link 212*a* so that the antenna is rotated about one axis. When power is transmitted from the first drive unit 110 to the first rotary link 212*a*, the first rotary link 212*a* may be rotated about the driving shaft of the first drive unit 110, the inner adjustment link 222*a*, which is connected to one end of the first rotary link 212*a*, may perform the rectilinear motion, and the inner gimbal 232, which is connected to one side of the inner adjustment link 222*a*, may be rotated about one axis. Therefore, the antenna may be rotated about one axis.

Figure 8:
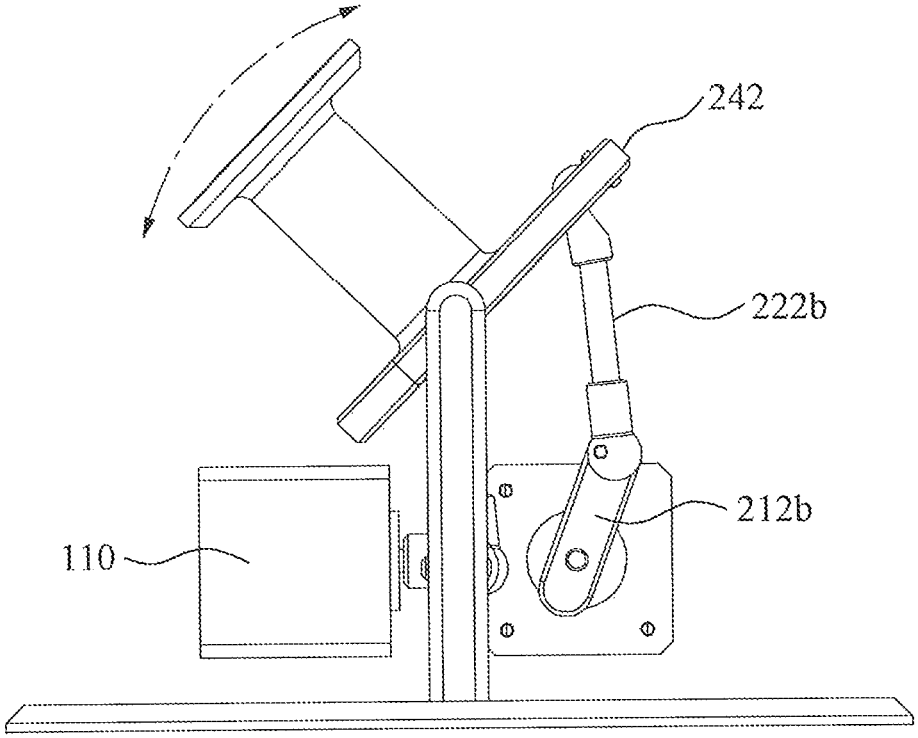
FIG. 8 is an operational view illustrating a state in which the pedestal apparatus according to the modified example is rotated about the other axis.

Referring to FIG. 8, the second drive unit 120 may rotate the second rotary link 212*b* so that the antenna is rotated about the other axis orthogonal to one axis. When power is transmitted from the second drive unit 120 to the second rotary link 212*b*, the second rotary link 212*b* may be rotated about the driving shaft of the second drive unit 120, the outer adjustment link 222*b*, which is connected to one end of the second rotary link 212*b*, may perform the rectilinear motion, and the outer gimbal 242, which is connected to one side of the outer adjustment link 222*b*, may be rotated about the other axis. Therefore, the antenna may be rotated about the other axis.

Figure 9:
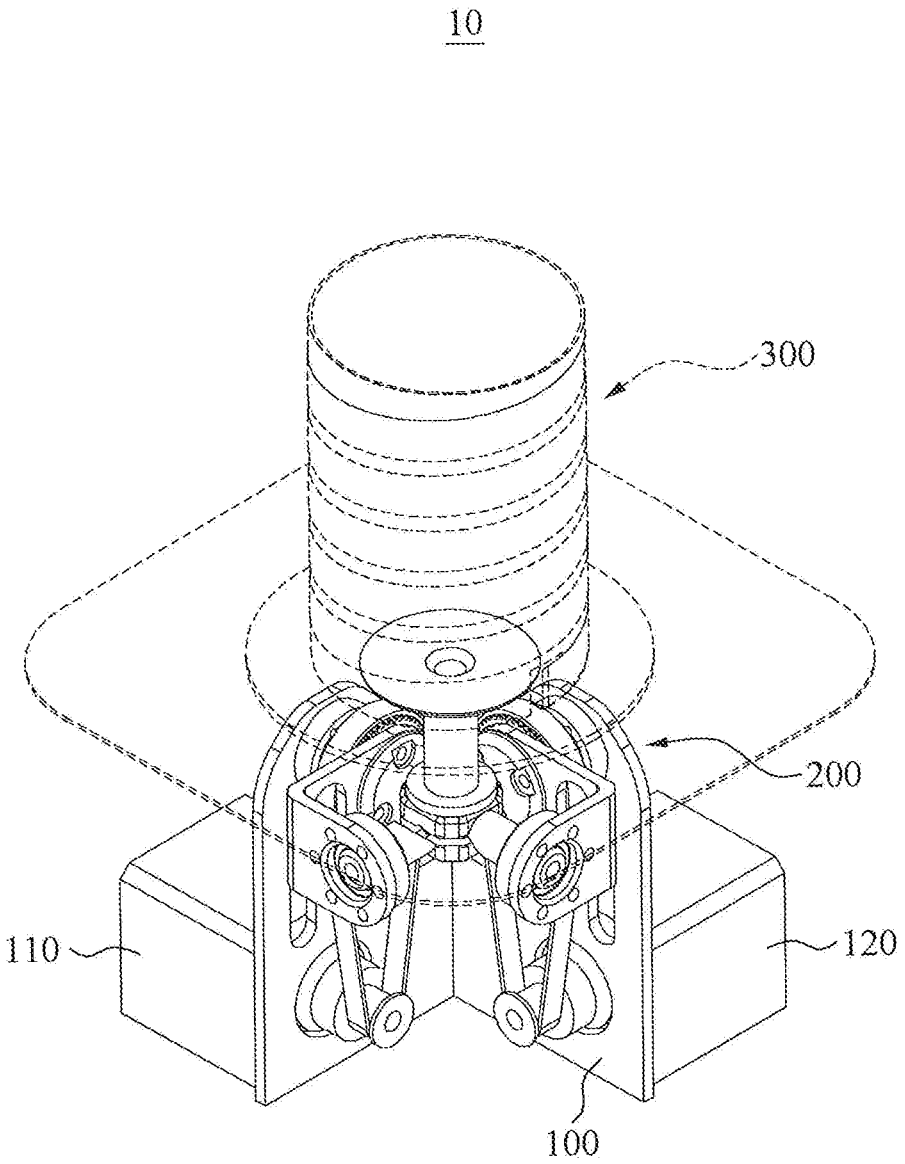
FIG. 9 is a perspective view schematically illustrating another modified example of the pedestal apparatus according to the exemplary embodiment.
Figure 10:
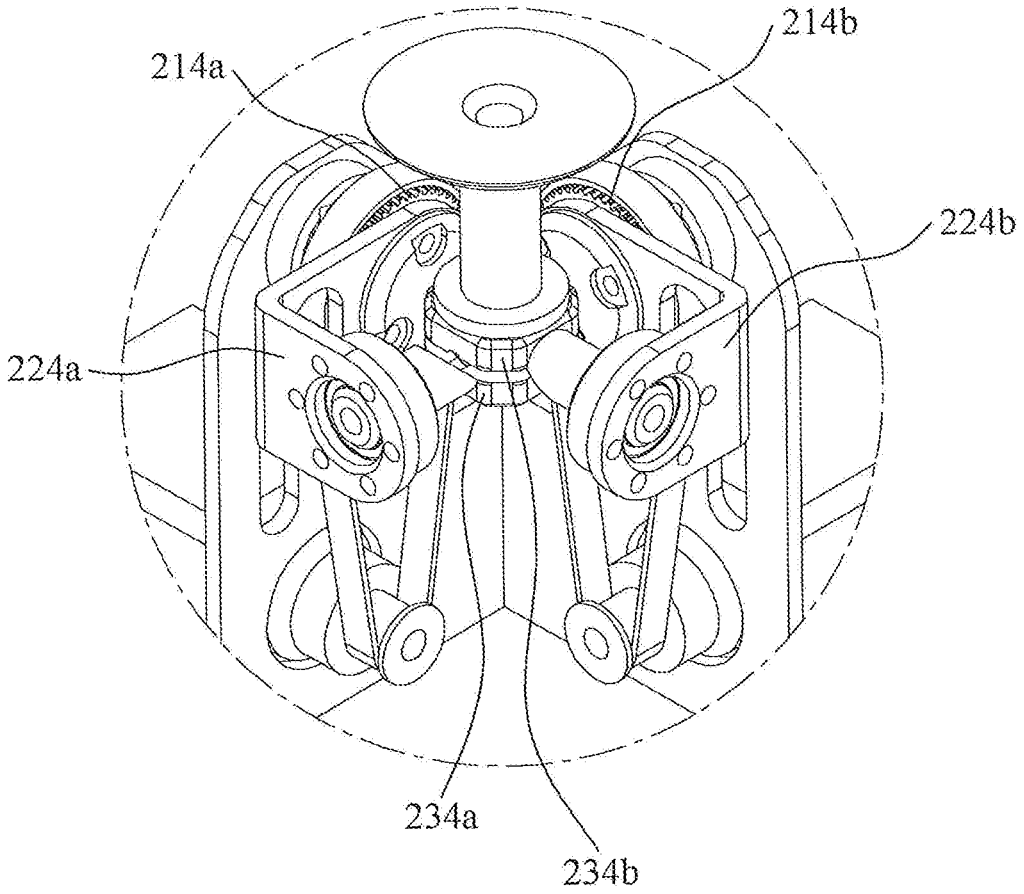
FIG. 10 is an enlarged view illustrating a configuration of a driving power transmitting unit of another modified example of the pedestal apparatus.

Referring to FIGS. 9 and 10, a driving power transmitting unit 200 may include a first driving gear 214*a* which is disposed on the upper portion of a body 100 and receives power from a first drive unit 110, and a second driving gear 214*b* which is disposed on the upper portion of the body 100 so as to be orthogonal to the first driving gear 214*a* and receives power from a second drive unit 120.

The first driving gear 214*a* is disposed on the upper portion of the body 100 and may receive power from the first drive unit 110. Specifically, the first driving gear 214*a* may be connected to a driving shaft of the first drive unit 110 by means of a first driving belt, and the first driving belt may transmit power, which is generated from the first drive unit 110, to the first driving gear 214*a*.

The second driving gear 214*b* is disposed on the upper portion of the body 100 and may receive power from the second drive unit 120. In addition, the second driving gear 214*b* may be disposed to be orthogonal to the first driving gear 214*a*. Specifically, the second driving gear 214*b* may be connected to a driving shaft of the second drive unit 120 by means of a second driving belt, and the second driving belt may transmit power, which is generated from the second drive unit 120, to the second driving gear 214*b*.

An antenna coupling unit 300 may include a first coupling portion 234*a* which is disposed at one side of the antenna coupling unit 300 and connected to the first driving gear 214*a*, and a second coupling portion 234*b* which is disposed adjacent to the first coupling portion 234*a* and connected to the second driving gear 214*b*.

The first coupling portion 234*a* may be disposed at one side of the antenna coupling unit 300. The first coupling portion 234*a* may be connected to the first driving gear 214*a*. Therefore, the power transmitted to the first driving gear 214*a* is transmitted to the first coupling portion 234*a*, and the antenna coupling unit 300, which includes the first coupling portion 234*a*, may be rotated, together with the first driving gear 214*a*, in a rotation direction of the first driving gear 214*a*.

The second coupling portion 234*b* may be disposed at one side of the antenna coupling unit 300 so as to be adjacent to the first coupling portion 234*a*. The second coupling portion 234*b* may be connected to the second driving gear 214*b*. Therefore, the power transmitted to the second driving gear 214*b* is transmitted to the second coupling portion 234*b*, and the antenna coupling unit 300, which includes the second coupling portion 234*b*, may be rotated, together with the second driving gear 214*b*, in a rotation direction of the second driving gear 214*b*.

The pedestal apparatus 10 may include a first rotary member 224*a* which is attached to the first driving gear 214*a* and may be rotated about one axis, and a second rotary member 224*b* which is attached to the second driving gear 214*b* and may be rotated about the other axis.

Figure 11:
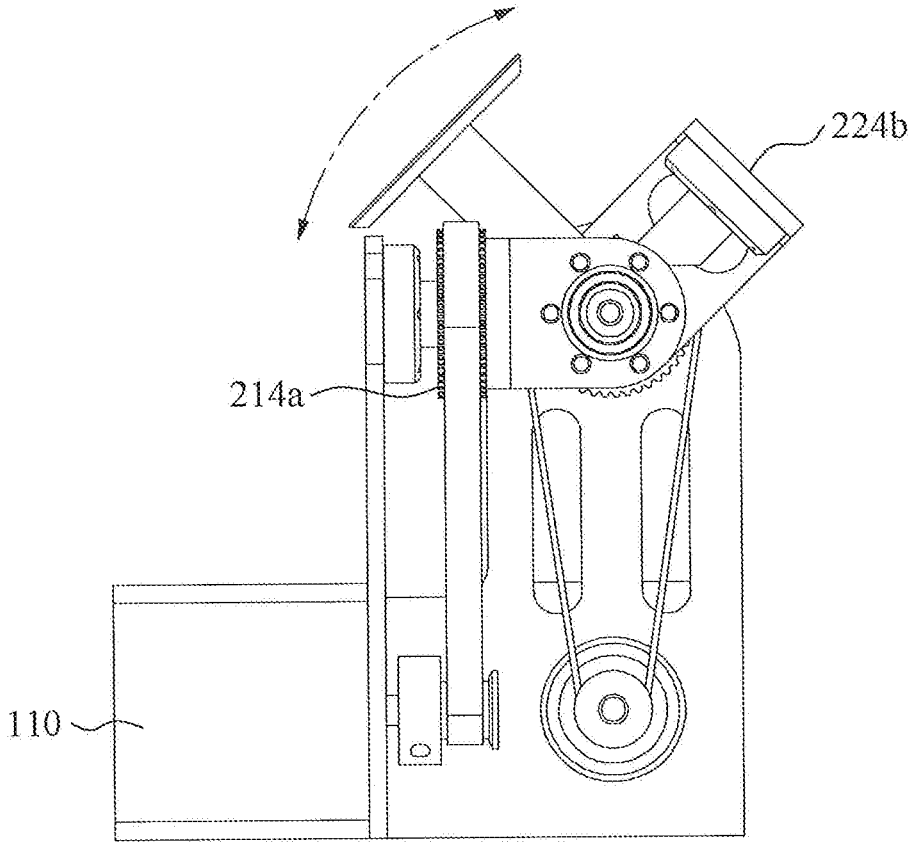
FIG. 11 is an operational view illustrating a state in which the pedestal apparatus according to another modified example is rotated about one axis.

Referring to FIG. 11, the second rotary member 224*b* is attached to the second driving gear 214*b* and may be rotated, together with the second driving gear 214*b*, in the rotation direction of the second driving gear 214*b*. In addition, the second rotary member 224*b* may be connected to the second coupling portion 234*b*. Specifically, the second rotary member 224*b* may include a second support shaft which is aligned with a rotation axis of the first driving gear 214*a* and connected to the second coupling portion 234*b*. The second rotary member 224*b* may extend along a circumference of the antenna coupling unit 300, and the second support shaft may be formed at one side of the extending second rotary member 224*b*. Therefore, the power transmitted from the second drive unit 120 is transmitted to the second driving gear 214*b*, and the second driving gear 214*b* is rotated, such that the second rotary member 224*b* may be rotated, together with the second driving gear 214*b*, in the rotation direction of the second driving gear 214*b*, and the antenna coupling unit 300, which is connected to the second rotary member 224*b* through the second support shaft, may be rotated, together with the second driving gear 214*b*, in the rotation direction of the second driving gear 214*b*.

Figure 12:
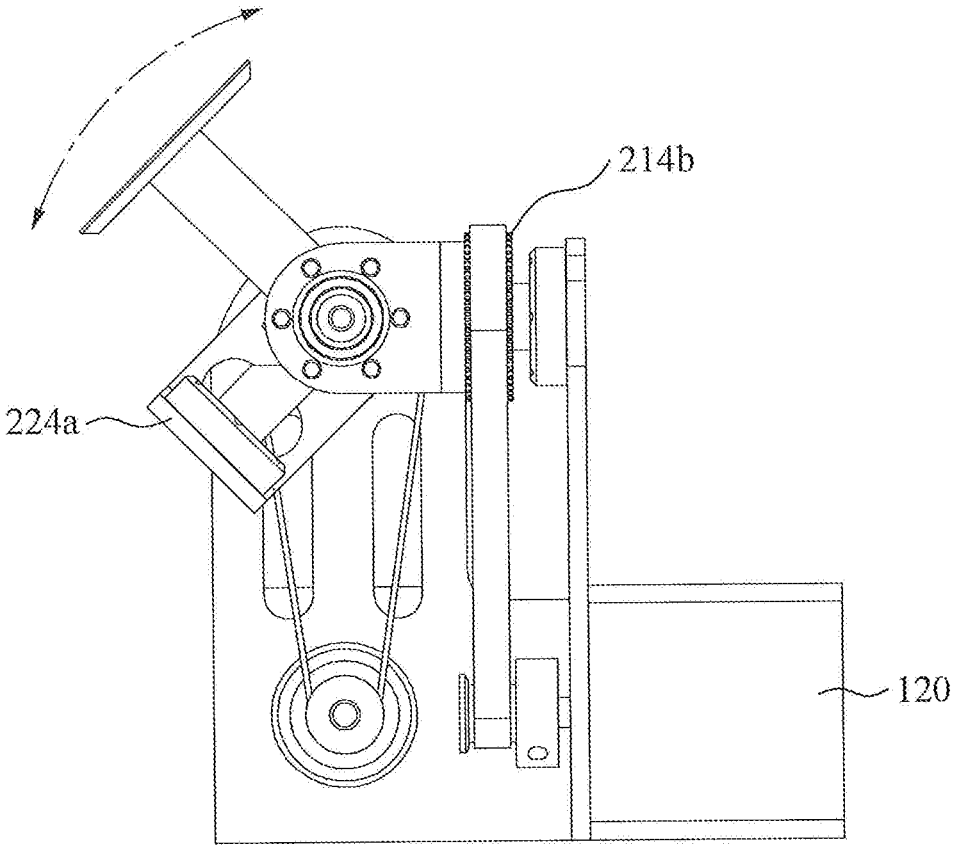
FIG. 12 is an operational view illustrating a state in which the pedestal apparatus according to another modified example is rotated about the other axis.

Referring to FIG. 12, the first rotary member 224*a* is attached to the first driving gear 214*a* and may be rotated, together with the first driving gear 214*a* in the rotation direction of the first driving gear 214*a*. In addition, the first rotary member 224*a* may be connected to the first coupling portion 234*a*. Specifically, the first rotary member 224*a* may include a first support shaft which is aligned with a rotation axis of the second driving gear 214*b* and connected to the first coupling portion 234*a*. The first rotary member 224*a* may extend along a circumference of the antenna coupling unit 300, and the first support shaft may be formed at one side of the extending first rotary member 224*a*. Therefore, the power transmitted from the first drive unit 110 is transmitted to the first driving gear 214*a*, and the first driving gear 214*a* is rotated, such that the first rotary member 224*a* may be rotated, together with the first driving gear 214*a*, in the rotation direction of the first driving gear 214*a*, and the antenna coupling unit 300, which is connected to the first rotary member 224*a* through the first support shaft, may be rotated, together with the first driving gear 214*a* in the rotation direction of the first driving gear 214*a*.

Figure 13:
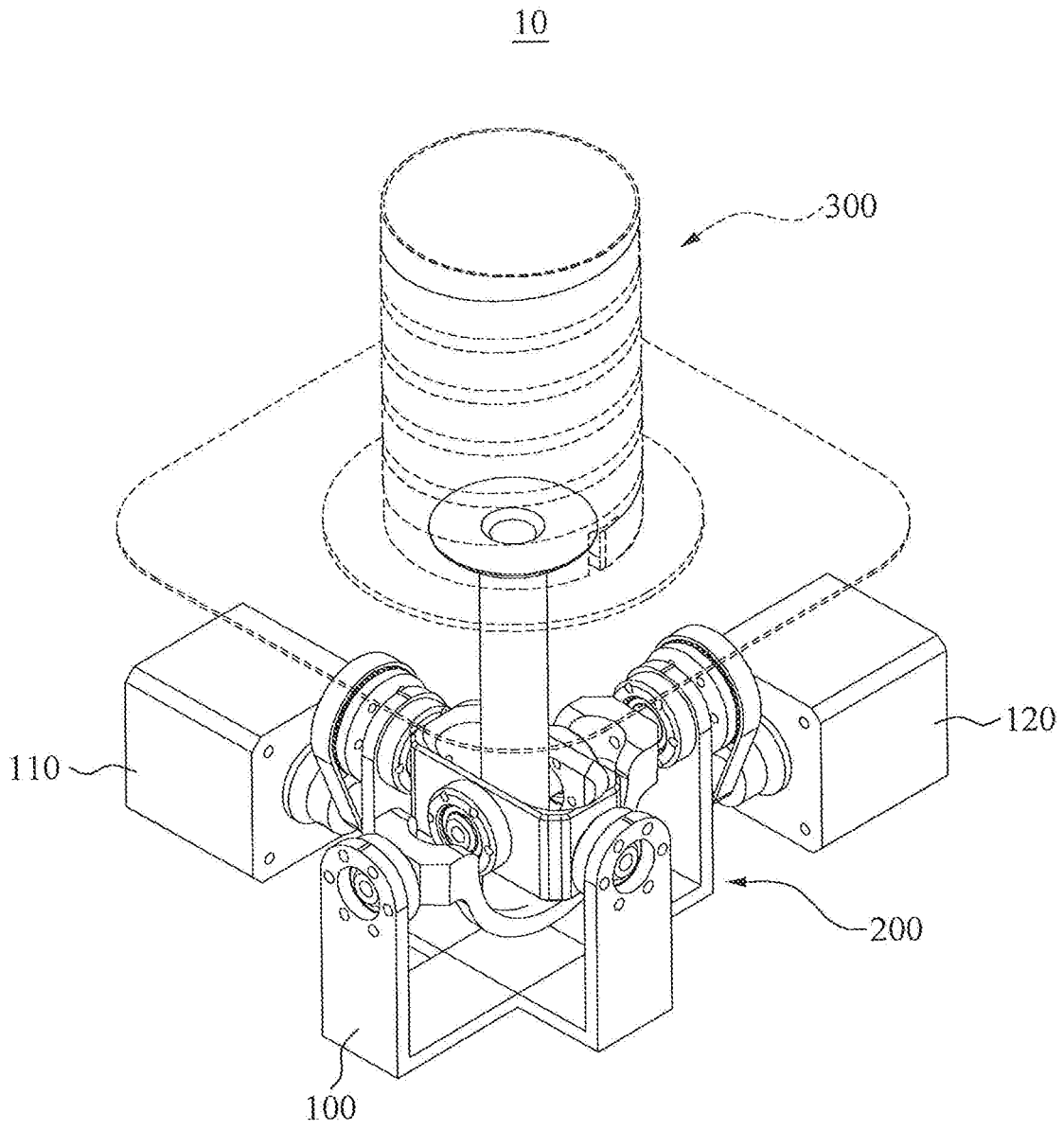
FIG. 13 is a perspective view schematically illustrating still another modified example of the pedestal apparatus according to the exemplary embodiment.
Figure 14:
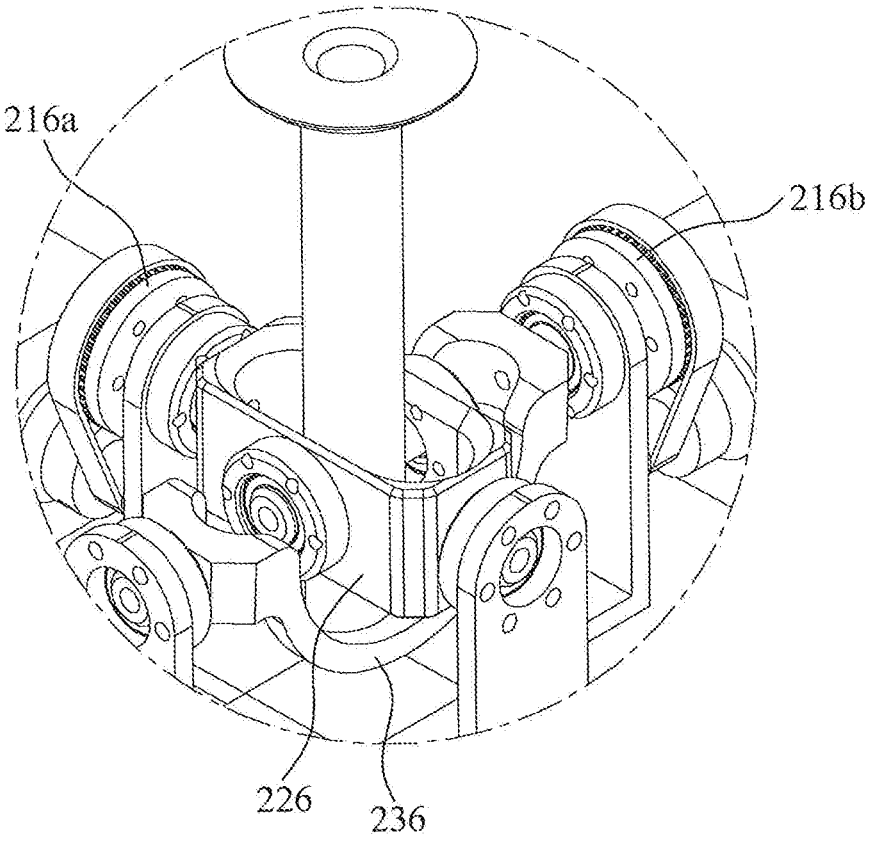
FIG. 14 is an enlarged view illustrating a configuration of a driving power transmitting unit of still another modified example of the pedestal apparatus.

Referring to FIGS. 13 and 14, a driving power transmitting unit 200 may include a first driving gear 216*a* which is disposed at a one side of the body 100 and receives power from a first drive unit 110, a second driving gear 216*b* which is disposed at the other side of the body 100 so as to be spaced apart from the first driving gear 216*a* and receives power from a second drive unit 120, an outer gimbal 236 which is connected to the first driving gear 216*a* inside the body 100 so as to be rotatable in one axial direction and has a first antenna path at one side thereof, and an inner gimbal 226 which is connected to the second driving gear 216*b* inside the body 100 so as to be rotatable in the other axial direction and has a second antenna path therein.

The first driving gear 216*a* may be connected to a driving shaft of the first drive unit 110 by means of a first driving belt, and the first driving belt may transmit power, which is generated from the first drive unit 110, to the first driving gear 216*a*.

The second driving gear 216*b* may be connected to a driving shaft of the second drive unit 120 by means of a second driving belt, and the second driving belt may transmit power, which is generated from the second drive unit 120, to the second driving gear 216*b*. In addition, the second driving gear 216*b* is orthogonal to the first driving gear 216*a* and may be disposed at the other side of the body 100 so as to be spaced apart from the first driving gear 216*a*.

The outer gimbal 236 may be connected to the first driving gear 216*a* inside the body 100 so as to be rotatable in one axial direction. Specifically, the outer gimbal 236 may have the first antenna path at one side thereof. Therefore, the antenna coupling unit 300 may be moved along the first antenna path in a longitudinal direction of the outer gimbal 236, that is, one axial direction and may be rotated about the other axial direction orthogonal to one axial direction.

In addition, the outer gimbal 236 may be formed in a curved shape in a direction outward from the body 100. The inner gimbal 226 may be disposed inside the outer gimbal 236 having a curved shape. The first antenna path may be formed along a circumference of the outer gimbal 236. Specifically, the first antenna path may be a curved path formed along the curved shape of the outer gimbal 236.

Likewise, the inner gimbal 226 may be connected to the second driving gear 216*b* inside the body 100 so as to be rotatable in the other axial direction orthogonal to one axial direction. Specifically, the inner gimbal 226 may have the second antenna path at one side thereof. Therefore, the antenna coupling unit 300 may be moved along the second antenna path in a longitudinal direction of the inner gimbal 226, that is, the other axial direction orthogonal to one axial direction and may be rotated about one axial direction.

The antenna coupling unit 300 may be disposed in the first antenna path and the second antenna path and connected to the inner gimbal 226.

Figure 15:
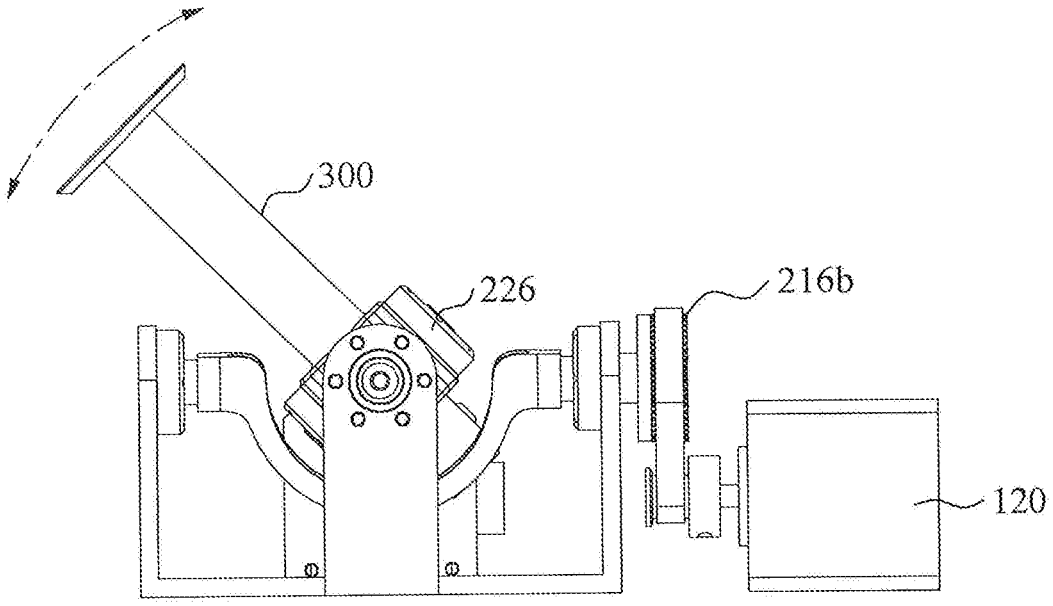
FIG. 15 is an operational view illustrating a state in which the pedestal apparatus according to still another modified example is rotated about one axis.

Referring to FIG. 15, the first drive unit 110 may rotate the first driving gear 216*a* so that the antenna coupling unit 300 is moved along the first antenna path. Therefore, the inner gimbal 226, which is connected to the first driving gear 216*a*, may be rotated about one axial direction, and the antenna coupling unit 300, which is connected to the inner gimbal 226, may be rotated about one axial direction in the rotation direction of the first driving gear 216*a* along the first antenna path together with the first driving gear 216*a*.

Figure 16:
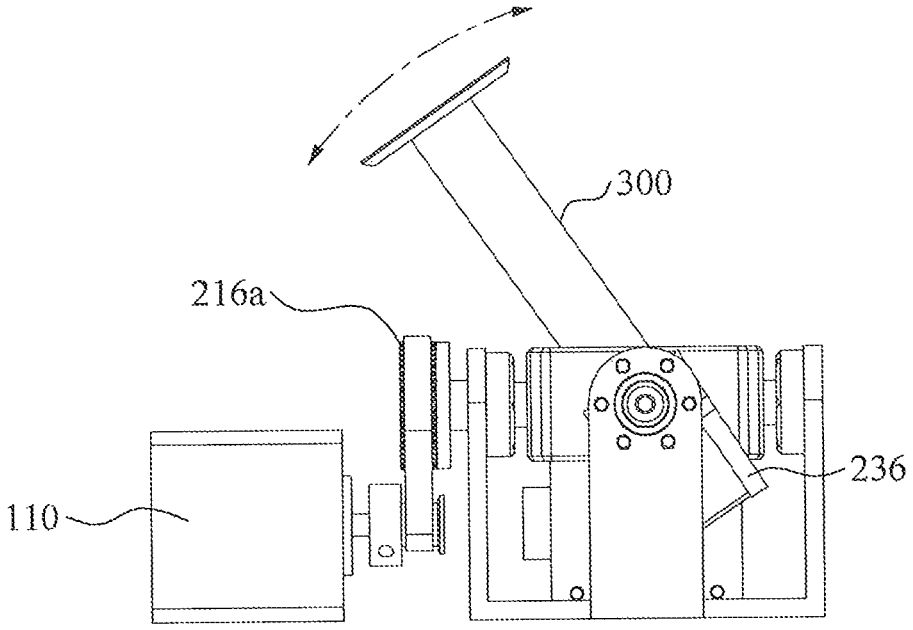
FIG. 16 is an operational view illustrating a state in which the pedestal apparatus according to still another modified example is rotated about the other axis.

Referring to FIG. 16, the second drive unit 120 may rotate the second driving gear 216*b* so that the antenna coupling unit 300 is moved along the second antenna path. Therefore, the outer gimbal 236, which is connected to the second driving gear 216*b*, may be rotated about the other axial direction orthogonal to one axial direction, and the antenna coupling unit 300, which is disposed in the first antenna path of the outer gimbal 236, may be rotated about the other axial direction in the rotation direction of the second driving gear 216*b* along the second antenna path together with the second driving gear 216*b*.

The pedestal apparatus according to the exemplary embodiment has an advantage in that it is possible to reduce a capacity and a weight of the motor and a capacity and a weight of the rotary joint, it is possible to improve structural stability, it is possible to allow antennae having various sizes to be mounted, it is possible to stably support a satellite tracking antenna, it is possible to maintain a position of an antenna in accordance with a direction of a target satellite even though an external state is changed, or it is possible to increase a tracking speed of an antenna.

While the present invention has been described above with reference to the limited exemplary embodiments and the drawings, the present invention may be variously modified and altered from the disclosure by those skilled in the art to which the present invention pertains. For example, appropriate results may be achieved even though the described technologies are performed in different orders from the described method, the described constituent elements such as the systems, the structures, the apparatuses, and the circuits are coupled or combined in different manners from the described method, and/or the constituent elements are substituted with or replaced by other constituent elements or equivalents.

Accordingly, other implements, other exemplary embodiments, and equivalents to the appended claims are also included in the scope of the appended claims.

The invention claimed is:

1. A pedestal apparatus having an antenna attached thereto capable of biaxial motion, the pedestal apparatus comprising:

a body;

a first drive unit which is disposed on a lower portion of the body and transmits power;

a second drive unit which is disposed on the lower portion of the body and transmits power;

a first driving gear which is disposed on an upper portion of the body and receives power from the first drive unit;

a second driving gear which is disposed on the upper portion of the body so as to face the first driving gear and receives power from the second drive unit; and a driven gear which is rotated by receiving power from the first driving gear and the second driving gear and connects to the antenna;

wherein the antenna performs biaxial motion in accordance with rotation directions of the first driving gear and the second driving gear; and wherein the first drive unit and the second drive unit rotate the first driving gear and the second driving gear in the same direction so that the antenna is rotated about one axis, and the first drive unit and the second drive unit rotate the first driving gear and the second driving gear in different directions so that the antenna is rotated about the other axis orthogonal to the one axis.

2. The pedestal apparatus of claim 1, comprising:

a first driving belt which is connected to a driving shaft of the first drive unit, controls the rotation direction of the first driving gear, and transmits power to the first driving gear, and a second driving belt which is connected to a driving shaft of the second drive unit, controls the rotation direction of the second driving gear, and transmits power to the second driving gear.

3. The pedestal apparatus of claim 2, wherein the driven gear includes:

a first driven gear which engages with the first driving gear and the second driving gear; and a second driven gear which faces the first driven gear and engages with the first driving gear and the second driving gear.

4. The pedestal apparatus of claim 3, comprising:

a first support member which is coupled to one side of the first driven gear and has a first support that extends radially from one side; and a second support member which is coupled to one side of the second driven gear and has a second support that extends radially from one side.

5. The pedestal apparatus of claim 4, comprising:

a support plate which is connected to the first support member and the second support member and has an antenna coupling hole in which the antenna is mounted.

6. A pedestal apparatus having an antenna attached thereto capable of biaxial motion, the pedestal apparatus comprising:

a body;

a first drive unit which is disposed adjacent to the body and transmits power;

a second drive unit which is disposed adjacent to the body and transmits power;

a driving power transmitting unit which is connected to the body and receives power from the first drive unit and the second drive unit to allow the antenna to perform biaxial motion; and an antenna coupling unit which is biaxially and rotatably connected to the driving power transmitting unit and has one end at which the antenna is mounted;

wherein the driving power transmitting unit includes:

a first rotary link which is connected to the first drive unit;

a second rotary link which is connected to the second drive unit;

an inner adjustment link which is coupled to one end of the first rotary link;

an outer adjustment link which is coupled to one end of the second rotary link;

an inner gimbal which has one side connected to the inner adjustment link and one end at which the antenna coupling unit is mounted; and an outer gimbal which has one side connected to the outer adjustment link and connects to the inner gimbal.

7. The pedestal apparatus of claim 6, wherein the first drive unit rotates the first rotary link so that the antenna is rotated about one axis, and the second drive unit rotates the second rotary link so that the antenna is rotated about the other axis orthogonal to one axis.

8. A pedestal apparatus having an antenna attached thereto capable of biaxial motion, the pedestal apparatus comprising:

a body;

a first drive unit which is disposed adjacent to the body and transmits power;

a second drive unit which is disposed adjacent to the body and transmits power;

a driving power transmitting unit which is connected to the body and receives power from the first drive unit and the second drive unit to allow the antenna to perform biaxial motion; and an antenna coupling unit which is biaxially and rotatably connected to the driving power transmitting unit and has one end at which the antenna is mounted;

wherein the driving power transmitting unit includes:

a first driving gear which is disposed on an upper portion of the body and receives power from the first drive unit; and a second driving gear which is disposed on the upper portion of the body so as to be orthogonal to the first driving gear and receives power from the second drive unit; and the antenna coupling unit includes:

a first coupling portion which is disposed at one side thereof and connected to the first driving gear; and a second coupling portion which is disposed adjacent to the first coupling portion and connected to the second driving gear.

9. The pedestal apparatus of claim 8, comprising:

a first rotary member which is attached to the first driving gear and rotatable about one axis; and a second rotary member which is attached to the second driving gear and rotatable about the other axis.

10. The pedestal apparatus of claim 9, wherein the first rotary member includes a first support shaft which is aligned with a rotation axis of the second driving gear and connected to the first coupling portion, and the second rotary member includes a second support shaft which is aligned with a rotation axis of the first driving gear and connected to the second coupling portion.

11. A pedestal apparatus having an antenna attached thereto capable of biaxial motion, the pedestal apparatus comprising:

a body;

a first drive unit which is disposed adjacent to the body and transmits power;

a second drive unit which is disposed adjacent to the body and transmits power;

a driving power transmitting unit which is connected to the body and receives power from the first drive unit and the second drive unit to allow the antenna to perform biaxial motion; and an antenna coupling unit which is biaxially and rotatably connected to the driving power transmitting unit and has one end at which the antenna is mounted;

wherein the driving power transmitting unit includes:

a first driving gear which is disposed at one side of the body and receives power from the first drive unit;

a second driving gear which is disposed at the other side of the body so as to be spaced apart from the first driving gear and receives power from the second drive unit;

an outer gimbal which is connected to the first driving gear inside the body so as to be rotatable in one axial direction and has a first antenna path at one side thereof; and an inner gimbal which is connected to the second driving gear inside the body so as to be rotatable in the other axial direction and has a second antenna path therein; and the antenna coupling unit is disposed in the first antenna path and the second antenna path and connected to the inner gimbal.

12. The pedestal apparatus of claim 11, wherein the first drive unit rotates the first driving gear so that the antenna coupling unit is moved along the first antenna path, the second drive unit rotates the second driving gear so that the antenna coupling unit is moved along the second antenna path, and the antenna performs biaxial motion in accordance with a rotation of the first driving gear and a rotation of the second driving gear.

13. The pedestal apparatus of claim 12, wherein the outer gimbal is formed in a curved shape in a direction outward from the body, and the first antenna path is formed along a circumference of the outer gimbal.

* * * * *